United States Patent [19]

Abe et al.

[11] 4,412,399

[45] Nov. 1, 1983

[54] JUGGLING TOY

[75] Inventors: Akira Abe, Tokyo; Tomihisa Tanimura, Mibu, both of Japan

[73] Assignee: Tomy Kogyo Co., Inc., Tokyo, Japan

[21] Appl. No.: 330,524

[22] Filed: Dec. 14, 1981

[30] Foreign Application Priority Data

Dec. 18, 1980 [JP] Japan ..... 55-182334

[51] Int. Cl.[3] ..... A63H 1/32

[52] U.S. Cl. ..... 46/47; 46/145

[58] Field of Search ..... 46/1 R, 47, 116, 47, 46/42, 43, 126, 128, 175 R, 117, 118, 145; 273/119 R, 129 W, 129 V, 129 R; 40/421, 418, 409, 46

[56] References Cited

U.S. PATENT DOCUMENTS

| | | | |
|---|---|---|---|
| 433,110 | 7/1890 | Walsh | 273/119 R |
| 3,043,050 | 7/1962 | Peterson | 46/47 X |
| 3,877,700 | 4/1975 | Moe | 273/129 X |
| 4,028,843 | 6/1977 | Appel | 46/1 R |
| 4,213,266 | 7/1980 | Hyland et al. | 46/1 R |

*Primary Examiner*—Mickey Yu

*Attorney, Agent, or Firm*—K. H. Boswell; Edward D. O'Brian

[57] ABSTRACT

A juggling toy includes a housing and a movable member movably located on the housing. A portion of the movable member serves as a juggling object. The member moves with respect to the housing such that the object is capable of reciprocally moving in an arcuate pathway with respect to the housing. An impulse member is located on the housing in association with the movable member. The impulse member is capable of interacting with the object in at least two points in the arcuate pathway of the object. Each of the interactions of the impulse member with the object are capable of at least inhibiting movement of the object in its current direction of travel and further capable of initiating movement of the object in the opposite direction of travel. The object is reciprocally moved in the arcuate pathway by alternately contacting the object with the impulse member to change its direction of movement.

7 Claims, 9 Drawing Figures

JUGGLING TOY

BACKGROUND OF THE INVENTION

This invention is directed to a toy which includes a housing having a movable means thereon capable of reciprocally moving in an arcuate pathway with respect to the housing. An impulse means is located on the housing in association with the movable means. The impulse means is capable of interacting with the movable means at at least two points within the arcuate pathway travelled by the movable means, and is capable at each of these points of reversing the direction of the movement of the movable means.

Toys which involve the passing of an object back and forth between two players or stations are known and described in patents such as U.S. Pat. Nos. 2,735,682; 3,857,564; 3,416,799; 2,799,501; Fench Pat. No. 1,066,421 and French Pat. No. 584,149. These toys are generally directed to competitive toys wherein two players oppose each other and attempt to pass a ball or disk from a first station to a second station or to an object receptacle such as a basketball hoop or the like.

Other toys are known wherein a tethered ball, tethered on a string, a pole attached to a flexible support or the like are known, wherein two players utilizing paddles, or some sort of mechanical paddles, bounce the tethered ball back and forth between each other. As with the previous group of patents, this type of toy is directed to a competitive type of toy between two people, and is not very suitable for use by pre-school children or the like, because of their lack of coordination and their inability and/or frustration in using the above noted toys.

Juggling is a very old art, and seems to fascinate young and old alike. As with the above noted competition type toys between two individuals, juggling is not a skill which is really attainable by a preschooler because of the lack of coordination.

BRIEF DESCRIPTION OF THE INVENTION

In view of the above, it is considered that, because of the fascination of young and old, with juggling, and with the lack of suitable toys for the pre-school age child, there exists a need for a toy directed to the pre-school age child which combines the fascination of juggling wherein an object is passed back and forth from one position to the other, yet does not require the coordination skills necessary in manipulating more complex toys. This invention is therefore directed to this need and it is a broad object of this invention to provide a toy which allows a child to mimic the actions of a juggler yet is simple enough in its use to not frustrate the child. Further, it is an object of this invention to provide a toy while fulfilling the above objects, also is usable in helping the child increase his coordination, eye-hand movement, and the like. Further, it is an object of this invention to provide a toy which, because of its simplicity of engineering, is both economical to manufacture, thus is economical to the consumer and is also durable, allowing for an extended, useful life of the toy.

These, and other objects, as will become evident in the remainder of this specification are achieved in a toy which comprises a housing, movable means rotatably mounted on said housing such that it is capable of reciprocal movement in an arcuate pathway with respect to said housing, impulse means located on said housing in association with said movable means and capable of interacting with said movable means at at least two points in said arcuate pathway, each of said interactions of said impulse means with said movable means capable of at least inhibiting movement of said movable means in at least one direction of movement and further capable of initiating a movement in the opposite direction. p Preferredly, the movable means would include a member rotatably mounted on said housing, and having an object means located on the surface thereof. Preferredly, the member is a transparent member, such that the object located on its surface traverses through the arcuate pathway and appears suspended in mid air as it traverses through this pathway, because of the transparency of the member.

Preferredly, the impulse means would be capable of interacting with the object means in four points on the arcuate pathway traversed by the object means. At two of these points the impulse means would be capable of inhibiting movement of the object means in a first direction, and further capable of initiating movement of the object means in a second direction, and in the remaining two of these points, the impulse means would be capable of inhibiting movement of the object means in the second direction, and further capable of initiating movement of the object in the first direction.

The impulse means can comprise a first and second element and an activation means. The activation means would be associated with the first and second elements and capable of moving the ends of each of these elements with respect to said housing, such that the ends of these elements are capable of contacting and moving the object means. Preferredly, the impulse means will comprise a first and second, and a third and fourth element grouped such that the first and third element and the second and fourth element are located in conjunction with one another. The first and third element would be capable of inhibiting movement of the object means in a first direction, and initiating movement of the object means in a second direction, and the second and third elements would be capable of inhibiting movement of the object means in the second direction, and initiating movement of the object means in the first direction.

DETAILED DESCRIPTION OF THE DRAWINGS

This invention will be better understood when taken in conjunction with the drawings wherein.

Figure 1:
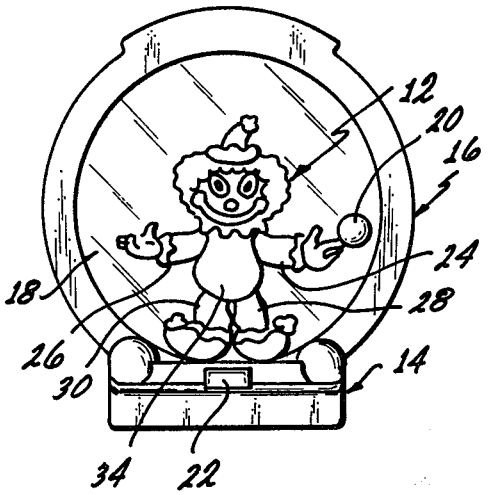
FIGS. 1, 2, 3 and 4 are front elevational views of the toy, showing the toy as it appears during its operation, with certain components of the toy in different positions between these figures.

The invention illustrated in the drawings and described in this specification utilizes certain principals and/or concepts as are set forth in the claims appended to this specification. It will be realized by those skilled in the toy arts that these principals and/or concepts are capable of being illustrated in a variety of embodiments differing from the embodiment utilized for illustrative purposes herein. For this reason, this invention is to be construed in light of the claims, and is not to be construed as being limited to only the illustrative embodiment.

DETAILED DESCRIPTION OF THE INVENTION

Referring to FIGS. 1 through 4, the toy 10 includes a small figurine designated by the numeral 12, which is mounted on a housing 14. Extending upwardly from the housing, and surrounding the figurine 12 is a circular shaped extension 16 of the housing 14. A transparent disk 18 is mounted within the extension 16 and includes a object 20 located in one position on its surface. An activation button 22 is located below the figurine 12. The figurine 12 includes right arm 24, left arm 26, right leg 28 and left leg 30, all of which are movable in response to depression of the activation button 22.

Briefly, the toy works as follows. The child playing with the toy depresses the activation button 22. This causes the right and left arms, 24 and 26, and the right and left legs, 28 and 30, respectively, to move upwardly and outwardly as can be seen by comparing FIG. 1 with FIG. 2, or FIG. 3 with FIG. 4. The disk 18 and the object 20 thereon, are free to spin with respect to the housing 14, as hereinafter explained. The center of rotation of the disk 18 is located at a position essentially behind the upper portion of the figurine 12.

Starting out with FIG. 1, when the object 20 is located as seen in FIG. 1, upon depression of the activation button 22, the arms and legs, 24, 26, 28, and 30, move upwardly and outwardly as noted before. In FIG. 1, the right arm 24 is in contact with the object 20. When the activation button 22 is depressed, a upwardly and outwardly movement of the right arm 24 imparts an impulse to the object 20, causing the object 20 and the disk 18 to which it is attached to move counterclockwise within the extension 16.

Figure 2:
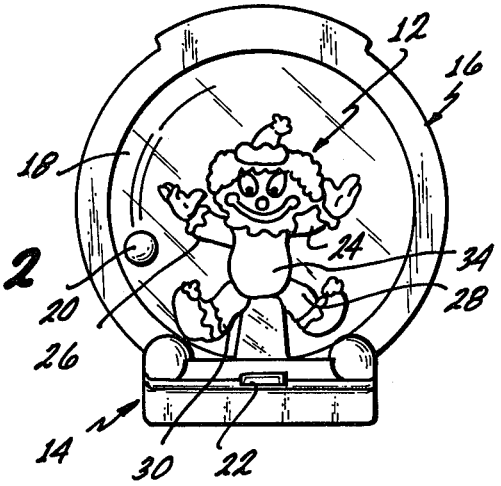
Figure 3:
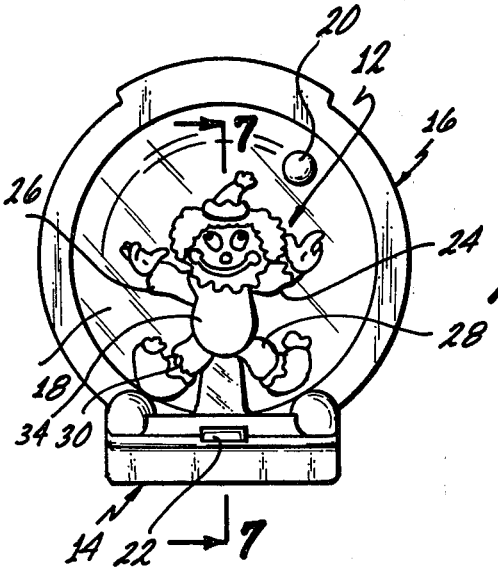

If the activation button is maintained in a depressed position, as seen in FIG. 2, the rotation of the disk 18 and the object 20 will rotate the object 20 past the outermost extension of the left arm 26, down toward the left leg 30. If the activation button 22 is released when the object 20 is located between the left arm 26 and the left leg 30, and the object is allowed to come to rest against the toe portion (not seperately identified or numbered) of the left leg 30 and the activation button 22 once again depressed, the left leg 30 will now impart to impulse to the object 20 and the disk 18, causing it to spin clockwise. In order for the object 20 to clear the outmost extension of the left arm 26, the activation button 22 must be maintained in a depressed position. If this happens, then the object travels between the position seen between FIGS. 2 and 3. If the activation button 22 is maintained in a depressed state, the object 20 will clear the outmost extremity of the right arm 24 and if this movement is coordinated with release of the activation button 22 as the object approaches the toe portion (not seperately identified or numbered) of the right leg 28, the object 20 will come to rest against the right leg 28, as is seen in FIG. 4.

Figure 4:
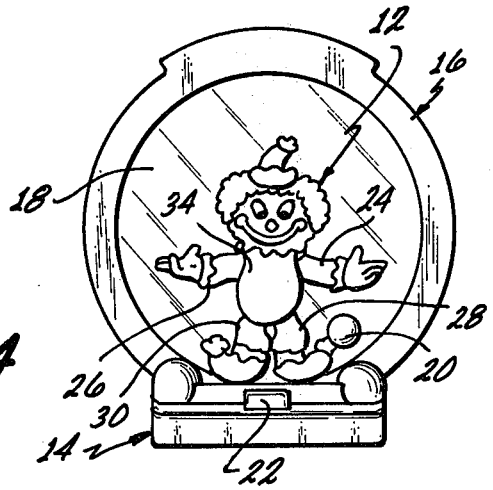

The figurine 12 can be made to juggle the object 20 back and forth between the right and left arms 24 and 26 by depressing the activation button 22 when the object 20 is against the right or left arm 24 and 26, imparting a momentum to the object, followed by release of the activation button 22 to extend the right and left arms 24 and 26 to positions as seen in FIGS. 1 and 4, to allow the object 20 to strike their extremities and thus be stopped. If this is followed be re-depression of the activation button 22, the object is caused to travel in the opposite direction toward the arm 24 or 26, opposite the arm which is giving it the momentum. This is the easiest way to operate the toy.

When the child becomes more sophisticated in the use of the toy, the child can operate the toy such that the figurine 12 juggles the object 20 off of the toes of the right and left leg 28 and 30, as previously described. Alternately, the child can one time cause one of the arms, 24 or 26 to stop the object 20 and reverse its direction, followed by utilizing the legs 28 or 30 toward which the object is travelling, to stop its momentum and reverse its direction. It will be appreciated with the object 20 will only be allowed to go into the space wherein it can be contacted by one of the legs 28 and 30, by maintaining the arms 24 and 26 out of the way, by keeping the activation button depressed as the object goes around the arms. When the activation button 22 is released, as is seen in FIG. 1, the object cannot clear the extremities of the arms, such as the right arm 24 in FIG. 1, but is stopped by the arm. The child can develop coordination and dexterity in playing with the game by alternating the juggling of the object 20 with the arms 24 and 26 and the legs 28 and 30.

When the activation button 22 is depressed, it must be depressed with sufficient force such that whichever of the limbs of the figurine 12, i.e. the right and left arms 24 and 26, or the right and left legs 28 and 30, contact the object 20, it does so with sufficient force to give enough impulse to the object 20 and the disk 18 to sufficiently rotate them enough to bring the object 20 in a position wherein it can be contacted by another of the limbs 24, 26, 28 or 30. If, in fact, the activation button 22 is not depressed with sufficient force, or if the timing of the pressing of the button 22 is not coordinated with the arrival of the object against tone of the above noted limbs, the impulse imparted to the object 20 by an improperly coordinated movement of the activation button 22 will not impart sufficient momentum to the object 20 and the disk 18 to cause them to rotate enough to locate the object 20 in a position where it can be contaced by a further one of the arms or legs 24, 26, 28 or 30. It is thus evident that the child will develop increased coordination skills and the like in playing with the toy 10.

At first the child will be simply able to juggle the object 20 back and forth between the ends of the arms 24 and 26. However, with further development of skills and coordination, the child will start to incorporate the use of the legs 28 and 30 in juggling the object 20 back and forth.

Referring now to FIGS. 5 through 9, the internal components of the figurine 12 and the activation button 22 are seen. Further, the method of suspension of the disk 18 on the housing 14 is also seen.

An upwardly extending section 32 of the housing 14 projects from a central location upwardly toward the center of the extension 16 of the housing 14. This section 32 is in its most part shaped as per the outline of the figurine 12 and contributes to the general appearance of the figurine 12. A face plat 34 fits onto section 32 and forms the body and head portion of the figurine 12. The face plate 34 has appropriate indicia thereon to supply the characteristic appearance of a clown, as seen in the illustrated embodiments of the Figs. Attachment of the plate 34 to the section 32 is via appropriate screws (not seperately identified or numbered) which allows for mounting of these two components together.

Figure 5:
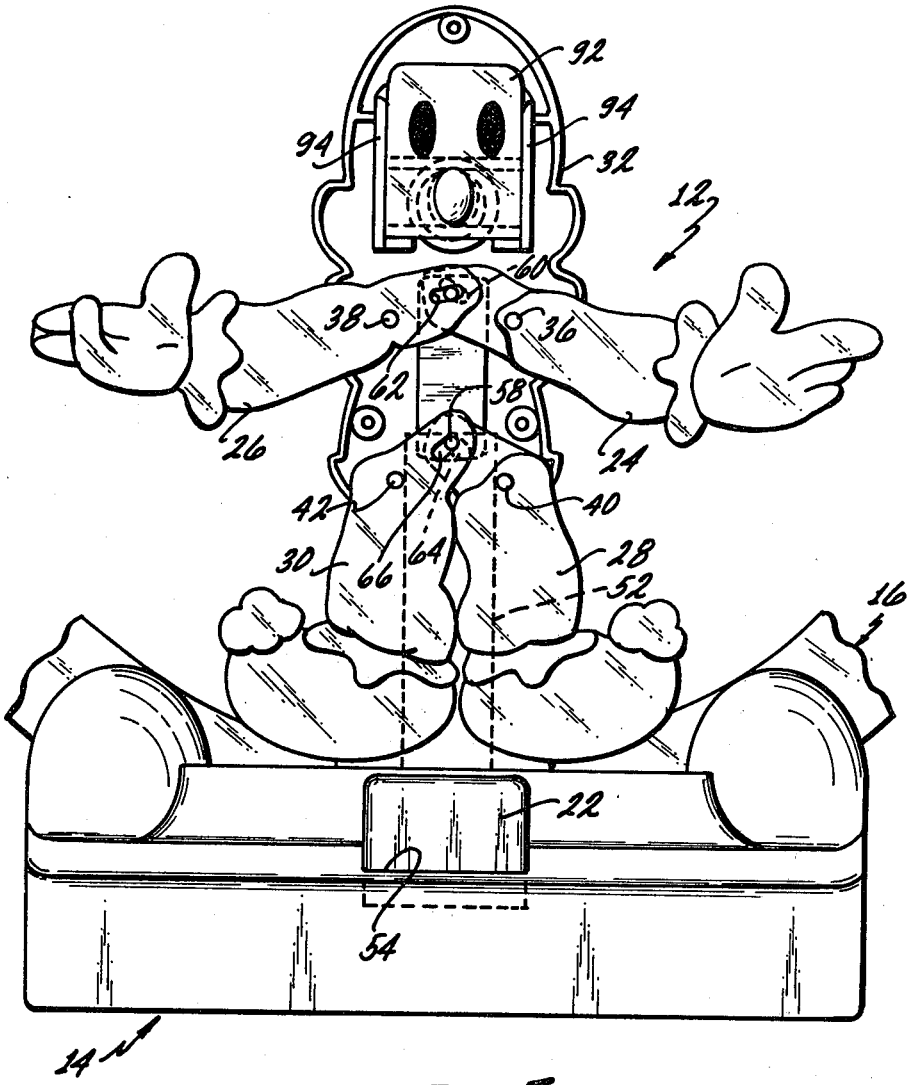
FIG. 5 is a front elevational view of the central portion of the toys seen in FIG. 1 with an overlaying component removed.
Figure 6:
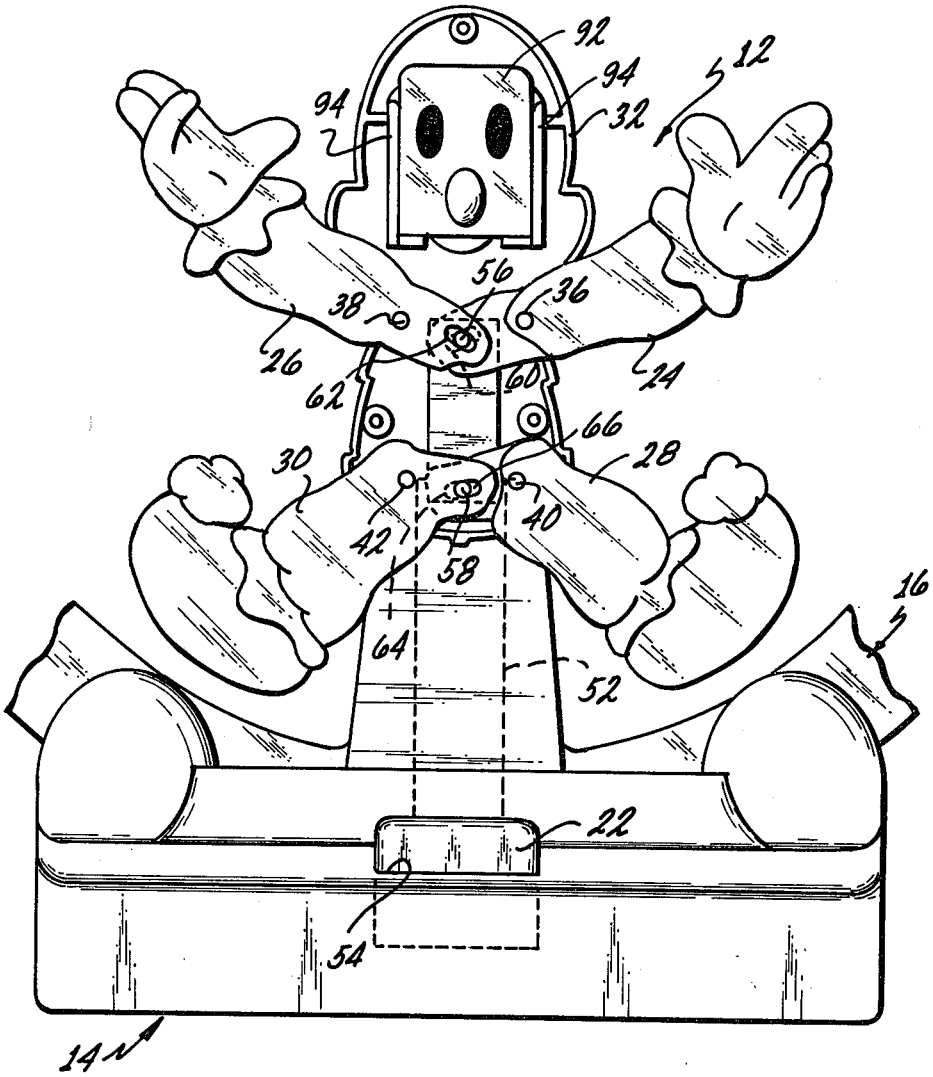
FIG. 6 is a front elevational view similar to FIG. 5 with certain of the components of the figures shown in a different spatial relationship than that in FIG. 5.
Figure 9:
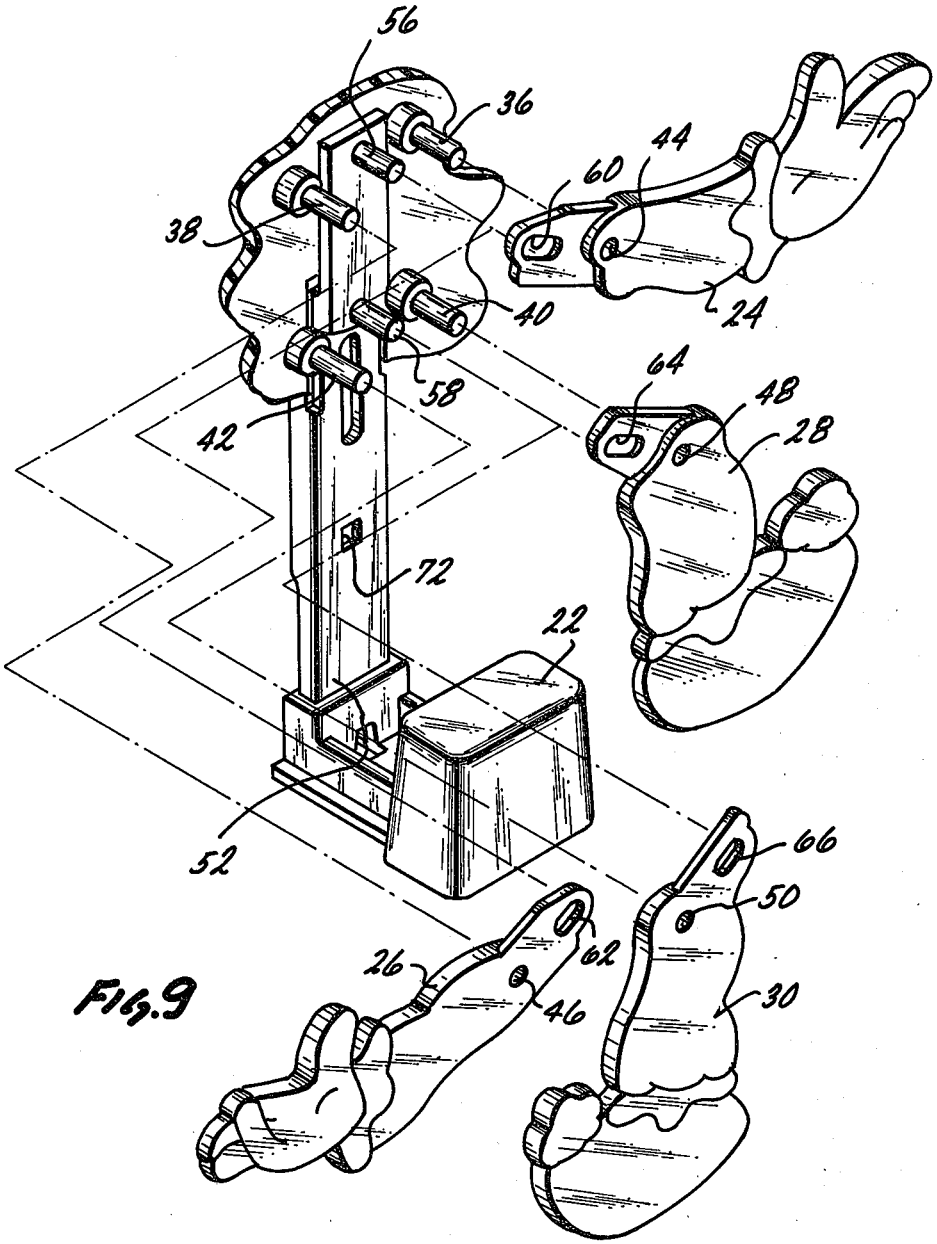
FIG. 9 is an exploded oblique view of certain of the components of FIGS. 5 and 6.

Referring now to FIGS. 5, 6 and 9 specifically, the section 32 has four bosses, boss 36, boss 38, boss 40, and boss 42 which extend horizontally outwardly from it and are hidden from view by the face plate 34 when it is located on the section 32. The right arm 24 has a hole 44 located in it which allows for mounting of the right arm 24 about the boss 36 by insertion of the boss 36 into the hole 44. In the same manner, the left arm 26, the right leg 28 and the left leg 30, contain holes 46, 48 and 50, respectively, which allow for appropriate mounting of these components about bosses 38, 40 and 42 respectively. When so mounted, the arms 24 and 26 and the legs 26 and 28 are thus first class levers, free to pivot about the respective bosses 36, 38, 40 and 42.

The activation button 22 is formed as a part of the activation member 52. The activation button 22 extends upwardly out of an appropriate hole 54 formed in the housing 14. The remaining portion of the activation member 52 is hidden within either the main part of the housing 14 or within the section 32. The upper portion of activation member 52 has two bosses 56 and 58 located thereon which extend horizontally outwardly fromthe main portion of the member 52. The right and left arms 24 and 26 each contain an appropriate slot 60 and 62 which fits over the boss 56 when the arms 24 and 26 are appropriately mounted about their bosses 36 and 38. In the same manner, the right and left legs 28 and 30 each contain appropriate slots 64 and 66 which fit over the boss 58 when the legs 28 and 30 are appropriately mounted about bosses 40 and 42.

On depression of the activation button 22, the activation member 52 is moved downwardly. This moves the bosses 56 and 58 downwardly with respect to the section 32 and the bosses 36, 38, 40 and 42 located thereon. The downward movement of the bosses 56 and 58 causes the arms 24 and 26 and the legs 28 and 30 to pivot about their respective mounting bosses as can be seen in FIG. 5 to FIG. 6. Thus, the downward deflection of the activation button 22 results in upward movement of the exposed portions of the arms 24 and 26 and the legs 28 and 30.

A spring 68 extends between a projection 70 located on the section 32 of the housing 14 and a projection 72 located on the activation member 52. The spring 68 biases the activation member 52 upwardly and, in turn, also biases the activation button 22 upwardly. When the activation button 22 is depressed, it moves the activation member 52 downwardly against the bias of the spring 68, stretching the same such that when the activation button 22 is released, the tension in the spring 68 returns the activation member 52 upwardly, which in turn moves the activation button 22 upwardly and the ends of the arms 24 and 26 and the legs 28 and 30 downwardly and inwardly.

A rear section 74 of the housing 14 extends upwardly in back of the disk 18. A bearing surface 76 is located near the upper periphery of the section 76. An insert 78 in the center of the disk 18 carries an axle 80 which fits into the bearing surface 76, forming a rear pivot point for the disk 18. An extension 82 on the center front of the disk 18 has a shoulder 84 which is located within a hole 86 in the section 32, which forms a front pivot point for the disk 18.

The axle 80 extends forward through the extension 82 and fits into an eccentrically located cam 88, integrally formed as a part of extension 82, located on its forward end. Rotation of the disk 18 about its center of rotation passing through axle 80 cause eccentric rotation of the cam 88. The cam 88 can be seen in a front view in FIG. 8.

Figure 7:
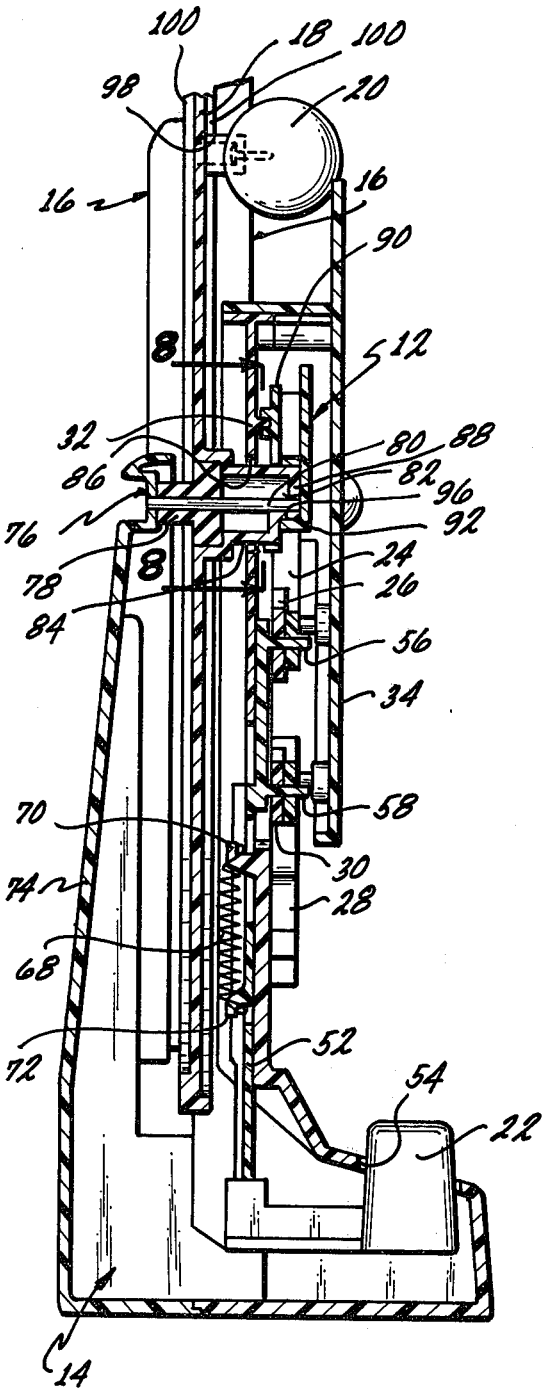
FIG. 7 is a side elevational view in partial section taken about the line 7—7 of FIG. 3.
Figure 8:
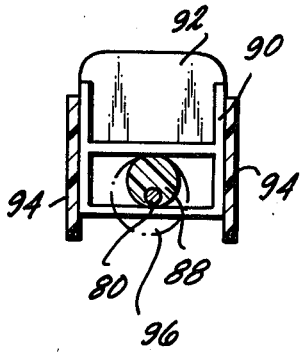
FIG. 8 is a ffront elevational view taken in section about the line 8—8 of FIG. 7.

A plate 90 is vertically held to the section 32 by a slot and channel, not seperately identified or numbered, but seen in FIG. 7. A second plate 92 rests against and is free to slide on the surface of the plate 90 in between two vertically extending ribs collectively identified by the numeral 94 in FIG. 8. The plate 92 has a hole 96 located therein into which the cam 88 fits. As the disk 18 turns, the cam 88 in turn is turned and it interacts with the sides of the hole 96, causing the plate 92 to slide with respect to the plate 90. The eyes of the figurine 12 are located on the plate 92 and, as can be seen in referring to FIGS. 1 through 4, as the disk 18 rotates, the movement transferred by this rotation to the plate 92 causes movement of the eyes within the eye sockets in the figurine 12.

The object 20, as can be seen in FIG. 7, is mounted to the disk 18 by appropriately attaching it to boss 98 extending outwardly from the surface of the disk 18. The disk 18 is made of a transparent material allowing viewing through it. Contrary to this, the object 20 is a solid, opaque material. By so locating the solid object 20 on the transparent disk 18, the object 20 appears suspended in air, when, in fact, it is fixedly located to a solid disk.

The extension 16 of the housing 14 surrounds the periphery of the disk 18 such that its outside perimeter is located within the extension 16. As can be seen in FIG. 7, there is a slight space 100 between the disk 18 and the front and the back of the extension 16. This allows for free movement of the disk 18 within the extension 16. The disk 18 is supported at its center via the axle 80 as previously described and thus is free to move with respect to the extension 16.

I claim:

1. A toy which comprises:

a housing;

movable means rotatably mounted on said housing such that it is capable of reciprocal movement in an arcuate pathway with respect to said housing;

moving means located on said housing in association with said movable means and capable of interacting with said movable means at at least two points in said arcuate pathway, each of said interactions of said moving means with said movable means capable of at least inhibiting movement of said movable means in one direction and further capable of initiating movement in the opposite direction;

at least a portion of said movale means comprises an object capable of moving in said arcuate pathway;

said moving means interacting with said object, said interaction of said moving means with said object capable of at least inhibiting the movement of said object in said one direction and further capable of initiating movement of said object in said other direction;

said moving means comprises a first and a second element and an element activation means, said first and said second element each having an end and each movably mounted on said housing such that said end of said first and said second elements is capable of moving and contacting said object, said first and said second elements each operatively associated with said element activation means and each movable in response to said element activation means.

2. The toy of claim 1 wherein:

said moving means is capable of interaction with said object in four points in said arcuate pathway, interaction in two of said points capable of at least inhibiting movement in a first direction and further capable of initiating movement in a second direction, interaction in the remaining two of said points capable of at least inhibiting movement in said second direction and further capable of initiating movement in said first direction.

3. The toy of claim 2 wherein:

said moving means further includes a third and a fourth element, said first, said second, said third and said fourth elements each having an end and each movably mounted on said housing such that said end of said first, said second, said third and said fourth elements is capable of moving and contacting said object, said first, said second, said third and said fourth elements each operatively associated with said element activation means and movable in response to said element activation means;

said first and said third elements capable of at least inhibiting movement of said object in said first direction and further capable of initiating movement of said object in said second direction, said second and said fourth elements capable of at least inhibiting movement of said object in said second direction and further capable of initiating movement of said object in said first direction.

4. The toy of claim 1 wherein:

said movable means includes a movable member rotatably mounted on said housing and capable of reciprocal rotation with respect to said housing, at least a portion of the movable member being transparent.

5. The toy of claim 4 wherein:

said object mounted on said movable member and moving in association with said member;

said first and second elements interacting with said object, said interaction of said elements with said object capable of at least inhibiting the movement of said object in said one direction and further capable of initiating movement of said object in said other direction.

6. The toy of claim 4 wherein:

said moving means is capable of interaction with said object in four points in said arcuate pathway, interaction in two of said points capable of at least inhibiting movement in a first direction and further capable of initiating movement in a second direction, interaction in the remaining two of said points capable of at least inhibiting movement in said second direction and further capable of initiating movement in said first direction.

7. The toy of claim 6 wherein:

said moving means further includes a third and a fourth element, said first, said second, said third and said fourth elements each having an end and each movably mounted on said housing such that said end of said first, said second, said third and said fourth elements is capable of moving and contacting said object, said first, said second, said third and said fourth elements each operatively associated with said element activation means and movable in response to said element activation means;

said first and said third elements capable of at least inhibiting movement of said object in said first direction and further capable of initiating movement of said object in said second direction and said second and said fourth elements capable of at least inhibiting movement of said object in said second direction and further capable of initiating movement of said object in said first direction.

* * * * *